US008584890B2

(12) United States Patent
Roberts

(10) Patent No.: US 8,584,890 B2
(45) **Date of Patent: *Nov. 19, 2013**

(54) MULTIPLE-OPENING CONTAINER AND METHOD

(76) Inventor: Thomas C. Roberts, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/596,416

(22) Filed: Aug. 28, 2012

(65) Prior Publication Data

US 2012/0317928 A1 Dec. 20, 2012

Related U.S. Application Data

(63) Continuation of application No. 11/682,740, filed on Mar. 6, 2007, now Pat. No. 8,261,929, which is a continuation-in-part of application No. 10/961,317, filed on Oct. 7, 2004, now abandoned.

(60) Provisional application No. 60/743,407, filed on Mar. 6, 2006.

(51) Int. Cl.
*B65D 1/24* (2006.01)

(52) U.S. Cl.
USPC ..... 220/524; 220/906; 220/269; 220/505

(58) Field of Classification Search
USPC ..... 220/269, 524, 906, 23.4, 23.2, 503, 220/505, 507, 553; 9/269, 524, 906, 23.4, 9/23.2, 503, 505, 507, 553
See application file for complete search history.

(56) References Cited

U.S. PATENT DOCUMENTS 3,081,926 A 3/1963 Newton
3,288,344 A * 11/1966 Woollen et al. ..... 229/103.1
3,467,269 A 9/1969 Newton
4,077,538 A 3/1978 Waterbury
4,139,114 A 2/1979 Long et al.

(Continued)

FOREIGN PATENT DOCUMENTS

FR 2502591 10/1982
GB 965508 7/1964

(Continued)

OTHER PUBLICATIONS

PCT; International Search Report dated Jul. 26, 2007 in PCT/US2007/005936.

(Continued)

*Primary Examiner* — Anthony Stashick
*Assistant Examiner* — Christopher McKinley
(74) *Attorney, Agent, or Firm* — Snell & Wilmer L.L.P.

(57) ABSTRACT

A multiple-opening container is configured to facilitate the simultaneous opening of two or more material containing compartments, thus allowing for the material contents within the multiple containing compartments to be suitably mixed upon pouring into another container. As a result of the simultaneous opening and pouring ability facilitated by the multiple-opening container, the time for mixing of multiple materials, such as beverages, fluids, powders or other like contents, can be suitably reduced. In addition, the de-carbonization and/or deterioration or other side affects caused from pre-mixing of the contents can be eliminated. In accordance with another exemplary embodiment, engagement portion can comprise a snap clip and a ring portion configured for sealed coupling to a material containing compartment. Second compartment can be suitably filled within beverages or other materials, and then positioned within the container portion and sealed or otherwise coupled by the engagement portion.

20 Claims, 10 Drawing Sheets

(56) References Cited

U.S. PATENT DOCUMENTS

| | | | | |
|---|---|---|---|---|
| 4,333,581 | A | 6/1982 | Flansburg | |
| 4,491,219 | A | 1/1985 | Lutz | |
| 4,901,877 | A | 2/1990 | Hall | |
| 4,919,295 | A * | 4/1990 | Hitzler | 220/23.83 |
| D321,128 | S | 10/1991 | De Bose | |
| 5,056,681 | A * | 10/1991 | Howes | 220/522 |
| 5,335,813 | A | 8/1994 | Qi | |
| 5,346,097 | A | 9/1994 | Melland et al. | |
| 5,397,014 | A | 3/1995 | Aydt | |
| 5,492,244 | A | 2/1996 | Kim | |
| 5,715,969 | A | 2/1998 | Seerup et al. | |
| 5,885,635 | A | 3/1999 | Spring et al. | |
| 5,934,501 | A | 8/1999 | Wright et al. | |
| 5,992,677 | A | 11/1999 | Ebine | |
| 6,363,978 | B2 | 4/2002 | Castillo | |
| D499,651 | S | 12/2004 | Gong | |
| 7,513,383 | B2 * | 4/2009 | Hwang | 220/269 |
| 2001/0030191 | A1 | 10/2001 | Bopp et al. | |
| 2002/0139800 | A1 | 10/2002 | Hwang et al. | |
| 2003/0189045 | A1 | 10/2003 | Hwang | |
| 2003/0189046 | A1 | 10/2003 | Quispe Gonzalez | |
| 2005/0077316 | A1 | 4/2005 | Roberts | |
| 2005/0173437 | A1 | 8/2005 | Hwang | |
| 2006/0065660 | A1 | 3/2006 | Kalaouze | |

FOREIGN PATENT DOCUMENTS

| | | |
|---|---|---|
| GB | 2315057 | 1/1998 |
| JP | 8-151043 | 6/1996 |
| WO | WO/97/21613 | 6/1997 |

OTHER PUBLICATIONS

USPTO; Office Action dated Sep. 29, 2010 in U.S. Appl. No. 11/682,740.

USPTO; Final Office Action dated May 10, 2011 in U.S. Appl. No. 11/682,740.

USPTO; Advisory Action dated Aug. 25, 2011 in U.S. Appl. No. 11/682,740.

USPTO; Office Action dated Sep. 23, 2011 in U.S. Appl. No. 11/682,740.

USPTO; Final Office Action dated Feb. 7, 2012 in U.S. Appl. No. 11/682,740.

USPTO; Notice of Allowance dated May 16, 2012 in U.S. Appl. No. 11/682,740.

USPTO; Office Action dated Jan. 5, 2007 in U.S. Appl. No. 10/961,317.

PCT; Written Opinion dated Jul. 26, 2007 in PCT/US2007/005936.

PCT; IPRP dated Jul. 26, 2007 in PCT/US2007/005936.

* cited by examiner

MULTIPLE-OPENING CONTAINER AND METHOD

CROSS-REFERENCE TO RELATED APPLICATIONS

This application is a continuation of, claims priority to and the benefit of, U.S. Ser. No. 11/682,740 entitled "MULTIPLE-OPENING CONTAINER AND METHOD" filed on Mar. 6, 2007, and issued on Sep. 11, 2012 as U.S. Pat. No. 8,261,929. The '740 application is a continuation-in-part of, claims priority to and the benefit of, U.S. Ser. No. 10/961,317 entitled "MULTIPLE-OPENING CONTAINER, AND METHOD" filed on Oct. 7, 2004. The '740 application also claims priority to and the benefit of U.S. Provisional Patent Application No. 60/743,407 entitled "MULTIPLE-OPENING CONTAINER AND METHOD" filed on Mar. 6, 2006. All of which are incorporated herein by reference.

TECHNICAL FIELD

The present invention relates, generally, to containers, and in particular to an improved container having multiple compartments with openings configured to facilitate simultaneous opening, pouring and mixing of multiple materials, such as beverages, fluids, powders and the like.

BACKGROUND OF THE INVENTION

Even with a wide variety of beverage choices being presently available for consumers, many individuals still choose to prepare mixed drinks for consumption. In many instances, the mixed drinks are made from the pouring of two or more desired beverages from two or more separate containers. While such a mixing practice is generally acceptable in instances when time is not critical, such as within the home or other casual settings, such practices are not desirable within a restaurant and/or bar environment wherein delays can potentially mean loss of revenues. Moreover, the supplying of various mixers, as well as managing the recipe for mixing a particular concoction, can be difficult for the average consumer to achieve on many occasions. For example, to provide for some carbonated and/or alcoholic drinks, a consumer must keep available numerous mixers and alcohols, even if only a small portion of each are needed.

While some products are offered in a premixed format, the premixing of many products leaves the resulting beverage with a less than desirable taste. For example, premixing of various mixers, such as juices, sodas and tonics, with alcohols, such as vodkas, gins and the like, can result in loss of the carbonation of the mixer, as well as potential deterioration of the alcohol.

SUMMARY OF THE INVENTION

In accordance with various aspects of the present invention, a multiple-opening container is provided. The multiple-opening container is configured to facilitate the simultaneous opening of two or more material containing compartments within the container, thus allowing for the contents within the multiple containing compartments to be simultaneous mixed upon pouring of the contents into another container, such as a pitcher, glass or cup or other like container. As a result of the simultaneous opening and pouring ability facilitated by the multiple-opening container, the time and inventory requirements for mixing of multiple materials, such as beverages, fluids, powders or other like contents, can be suitably reduced. In addition, the de-carbonization and/or deterioration or other side affects caused from pre-mixing of the contents can be eliminated.

In accordance with an exemplary embodiment, a multiple opening container comprises a container portion and an engagement device, with the container portion comprising two or more material containing compartments, and the engagement device having at least a dual-tab member configured for simultaneous opening of the two or more material containing compartments. The material containing compartments can comprise various sizes and volumes, depending upon any desired mixing criteria or formulation. In addition, an exemplary multiple opening container can also be configured for simultaneous opening and mixing of more than two materials, such as two or more beverages, powders, fluids and other like contents. The simultaneous opening through the engagement device allows for at least two materials within the multiple opening container to be suitably mixed after simultaneous pouring. As a result of the simultaneous opening, the contents can be simultaneously poured and mixed in a specific proportion based on the respective volumes of the multiple material containing compartments.

In accordance with another exemplary embodiment, engagement device can comprise a snap clip and a ring portion configured for sealed coupling to a material containing compartment. In an exemplary embodiment, the second compartment can be suitably filled with beverages or other materials, and then positioned within the container portion and sealed or otherwise coupled by the engagement device.

BRIEF DESCRIPTION OF THE DRAWINGS

The exemplary embodiments of the present invention will be described in connection with the appended drawing figures in which like numerals denote like elements and.

DETAILED DESCRIPTION

The present invention may be described herein in terms of various mechanical components, and it should be appreciated that such mechanical components may be realized by any number of devices configured to perform the specified functions. In addition, the present invention may be practiced in any number of material contexts and the containers described herein are merely a few of the exemplary applications for the invention. Further, it should be noted that the present invention may employ any number of conventional techniques for the containing of materials, such as beverages, fluids, powders and the like.

In accordance with various aspects of the present invention, a multiple-opening container is provided. The multiple-opening container is configured to facilitate the simultaneous opening of two or more material containing compartments, thus allowing for the material contents, such as beverages, powders, fluids and the like, within the multiple containing compartments to be suitably mixed upon simultaneous pouring of the material contents into another container, such as a pitcher, glass or cup or other like container. As a result of the simultaneous opening and pouring ability facilitated by the multiple-opening container, the time for mixing of multiple materials, such as beverages, fluids, powders or other like contents, can be suitably reduced.

While an exemplary multiple opening container can be configured for containing and facilitating mixing of two or more fluids, powders and/or other substances, a multiple opening beverage container will be provided for illustrative purposes. For example, with reference to FIG. 1, in accordance with an exemplary embodiment, a multiple opening container 100 as may be used for containing and facilitating the mixing of two or more beverages comprises a container portion 102 and an engagement device 104.

Container portion 102 is configured to contain from within at least two material containing compartments. Container portion 102 can be configured in various sizes, shapes and orientations for containing and/or defining material compartments. In accordance with an exemplary embodiment, multiple opening container 100 can comprise an outer cylindrical shape; however, container portion 102 is not limited to that illustrated in the exemplary embodiment, and can comprise any outer shape or configuration for containing materials. For example, container 100 can also comprise a substantially square outer-shaped container, e.g., a milk or juice carton, a pentagonal, hexagonal or other multi-sided container, or any other container configuration.

Figure 3:
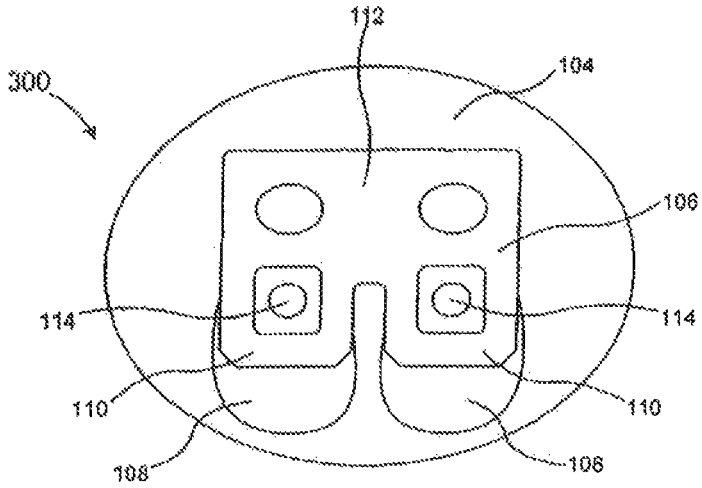
FIG. 3 illustrates a top view of an exemplary multiple-opening container in accordance with an exemplary embodiment of the present invention.

Engagement device 104 is configured for simultaneous opening of the at least two material containing compartments. In accordance with an exemplary embodiment, with additional reference to FIG. 3, engagement device 104 is further configured to cap/enclose container portion 102 in order to provide a sealed closure to any beverages or other materials within the material containing compartments. In the exemplary embodiment, engagement device 104 comprises a single, unitary structure comprising a dual-tab member 106, at least two cap members 108, and a handle portion 112.

Cap members 108 can comprise various configurations for capping or sealing of material containing compartments. For example, with momentary reference to FIG. 3, cap members 108 can comprise conventional tear drop-shaped caps configured for capping/sealing beverage cans. However, cap members 108 can comprise various other shapes, such as oval, circular, rectangular, triangular or other multi-sided shapes, or any combination thereof.

Handle portion 112 is configured to enable engagement device 104 to be suitably gripped, e.g., held by a user, to initiate and control operation of engagement device 104 during opening of container portion 102. In accordance with an exemplary embodiment, handle portion 112 can comprise, for example, a finger-engaging portion, such as to enable gripping by fingers to operate engagement device 104. Handle portion can also be configured without finger-engaging portions, and/or can comprise a single member or multiple members, and/or any outer shape, configuration or thickness that can enable gripping or operating by someone desiring to simultaneously opening container 100. Accordingly, handle portion 112 can also comprise any configuration that facilitates removal and/or opening of cap members 108 from container portion 102.

Dual-tab member 106 is configured to facilitate simultaneous opening of two material containing compartments. In accordance with an exemplary embodiment, dual-tab member 106 comprises contact portions 110 configured to open or otherwise unseal cap members 108. For example, dual-tab member 106 can be configured to simultaneously force open cap members 108, e.g., through engagement of contact portions 110 to cap members 108, upon pulling upwards of a handle portion 112. Cap members 108 can be suitably placed anywhere proximate to dual-tab member 106 such that contact portions 110 can force open or puncture cap members 108. Like cap members 108, dual-tab member 106 and contact portions 110 can comprise any shape or configuration for facilitating simultaneous forcing open of cap members 108. For example, dual-tab member and contact portions 110 can be configured to suitably pivot about and/or pull away from the top of container portion 102 to suitably force open, e.g., push down or pull-out, cap members 108.

In accordance with an exemplary embodiment, cap members 108 can be suitably integrated into dual-tab member 106 through locking portions 114 to fixedly attach cap members 108 to dual-tab member 106. However, cap members 108 can also be integrally molded or formed within dual-tab member 106. In addition, rather than being fixedly attached in a substantially permanent fashion, e.g., like many beverage cans, cap members 108 and dual-tab member 106 can also be configured as separate components, only mated together when simultaneous opening of cap members 108 is desired, e.g., dual-tab member 106 can comprise a separate tool device configured to engage with cap members 108 configured with engagement components to facilitate locking or connection to dual-tab member 106.

Figure 2:
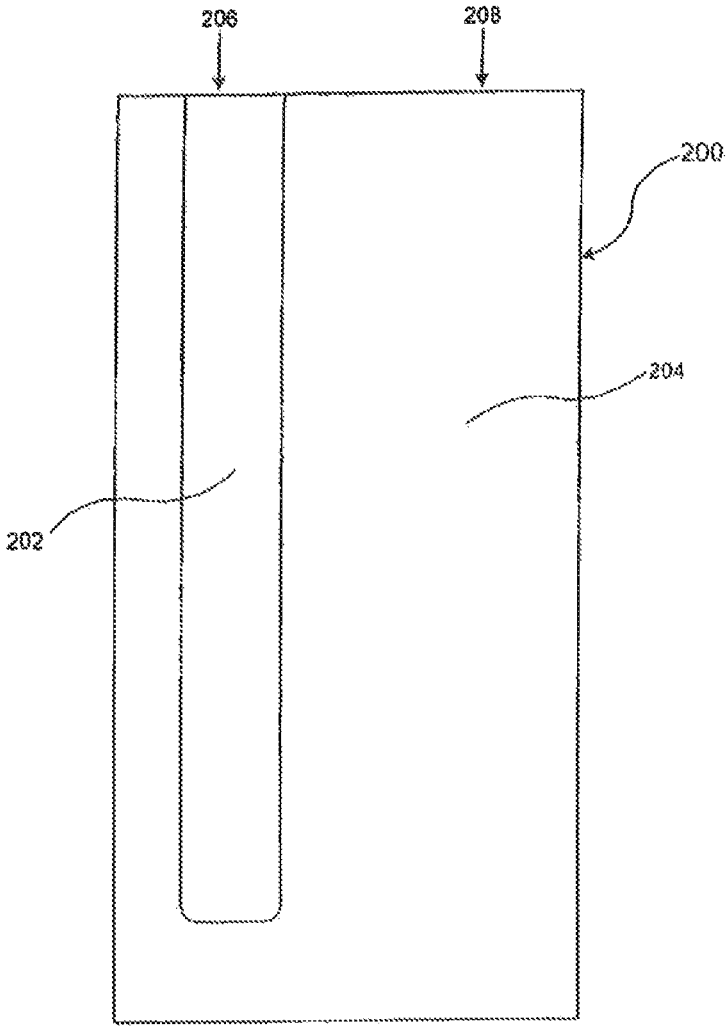
FIG. 2 illustrates a cross-sectional view of an exemplary multiple-opening container having two material containing compartments in accordance with an exemplary embodiment of the present invention.

Container portion 102 is configured to contain at least two material containing compartments. For example, with additional reference to an exemplary embodiment illustrated in FIG. 2, a container portion 200 can comprise within a first compartment 202 and a second compartment 204 having a first opening 206 and a second opening 208, respectively. To facilitate efficient simultaneous pouring of materials, openings 206 and 208 of first and second compartments 202 and 204 can be located proximately together, e.g., within less than 180 degrees apart in a cylindrical container application, or within any other distance that allows simultaneous pouring of materials without substantial spreading or spillage outside of the intended second container or area. In other words, locating openings 206 and 208 proximate together can enable the materials within multiple-opening container 200 to be emptied together without a high risk of spillage or other like problems.

First and second compartments 202 and 204 can comprise various volumes, shapes and configurations. For example, first compartment 202 can comprise a smaller tube or other like chamber, such as one configured for containing of a beverage having a smaller proportion to be mixed, e.g., alcohol, while second compartment 204 can comprise a larger chamber or tube, or the remainder of the area within container portion 102 not otherwise occupied by first compartment 202. Having a smaller tube or chamber configured for containing a particular proportion of a material can substantially maintain the material within container portion 102 without extreme disturbance, e.g., having 50% or less volume within first compartment 202 can allow for a material to be significantly shaken about during transport.

To facilitate more efficient simultaneous pouring, in accordance with an exemplary embodiment, container portion 102 comprises openings 206 and 208 configured proximate together and/or to an edge; in this example, first compartment 202 and second compartment 204 are positioned underneath the openings, i.e., below cap members 108, and may be coupled to the openings in any manner. For example, first compartment 202 and/or second compartment 204 may comprise tubes or chambers having an angled portion to enable coupling to openings 206 and 208 with a majority of first compartment 202 and/or second compartment 204 located towards a center of container 100, or such tubes or chambers may have a majority located directly underneath openings 206 and 208.

In accordance with another exemplary embodiment, a single partition member can suitably define first and second compartments 202 and 204; moreover, another divider configuration can be provided within container portion 102 to suitably divide compartments 202 and 204 into desired volumes. Accordingly, irrespective of the manner for defining first and second compartments 202 and 204, e.g., whether by tube, chamber, partition members or some combination thereof, the amount of materials that are contained within first and second compartments 202 and 204 can be determined based on the amount of desired proportions of the materials to be mixed.

The arrangement of dual tab member 106 and the simultaneous opening of dual compartments 202 and 204 allows for the materials within to be suitably mixed after opening in a desired proportion in a simultaneous fashion. Accordingly, in an application where carbonated material, such as soda or other carbonated mixers, and an alcohol are to be suitably mixed, the de-carbonization and/or deterioration or other side affects caused from pre-mixing of such materials can be eliminated.

Figure 1:
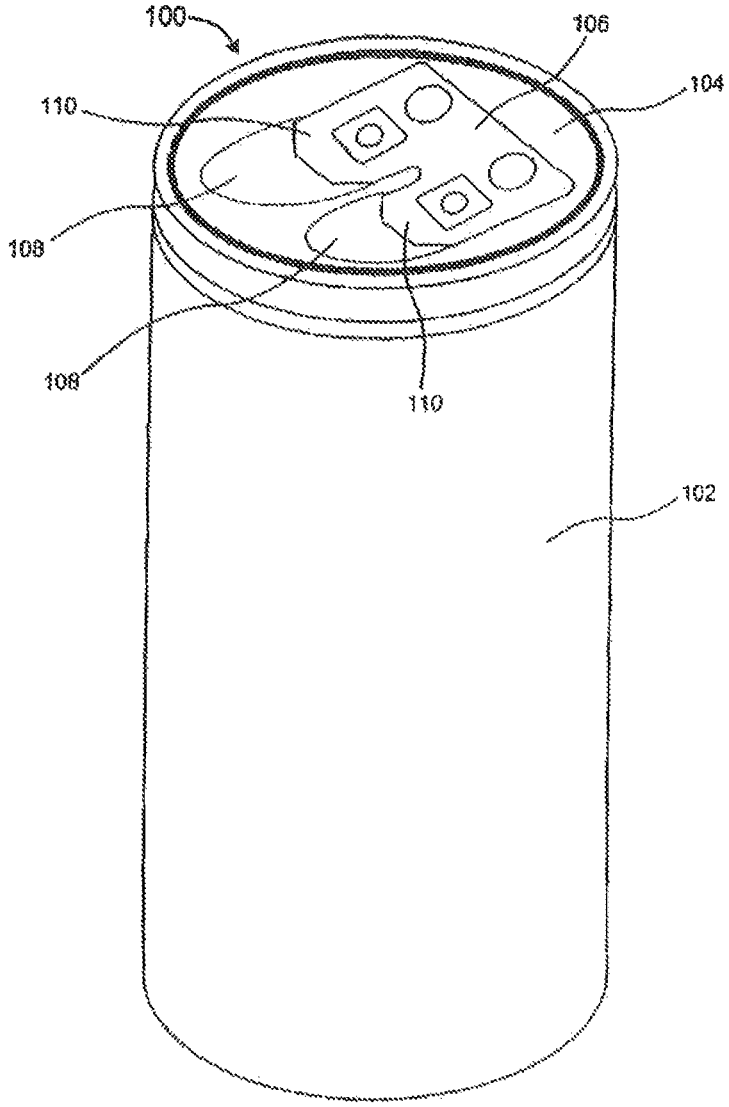
FIG. 1 illustrates a perspective view of an exemplary multiple-opening container in accordance with an exemplary embodiment of the present invention.
Figure 4:
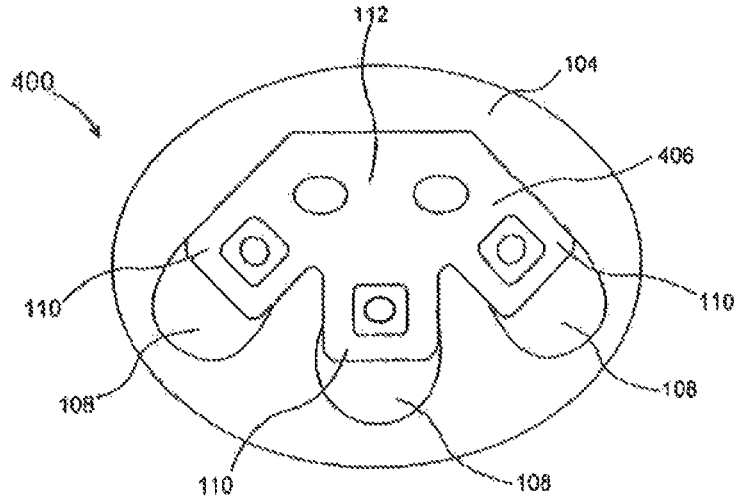
FIG. 4 illustrates a top view of an exemplary multiple-opening container in accordance with another exemplary embodiment of the present invention.

In addition to the dual opening container as illustrated in the exemplary embodiment of FIG. 1, an exemplary multiple opening container can also be configured for simultaneous opening, pouring and mixing of more than two materials. For example, with reference to a top view of an exemplary embodiment illustrated in FIG. 4, a multiple-material container 400 can comprise a tab member 406 having more than two contact portions 110 and cap members 108, e.g., three contact portions 110 and three cap members 108 for use with three material containing compartments. For example, tri-tab member 406 can be suitably configured to simultaneously open three beverage compartments to facilitate simultaneous mixing of different beverages, wherein each of cap members 108 are positioned such that simultaneous opening thereof will permit simultaneous pouring of at least three materials with minimal spillage. Moreover, more than three contact portions 110, cap members 108 and compartments can also be included in various other exemplary embodiments.

Figure 5A:
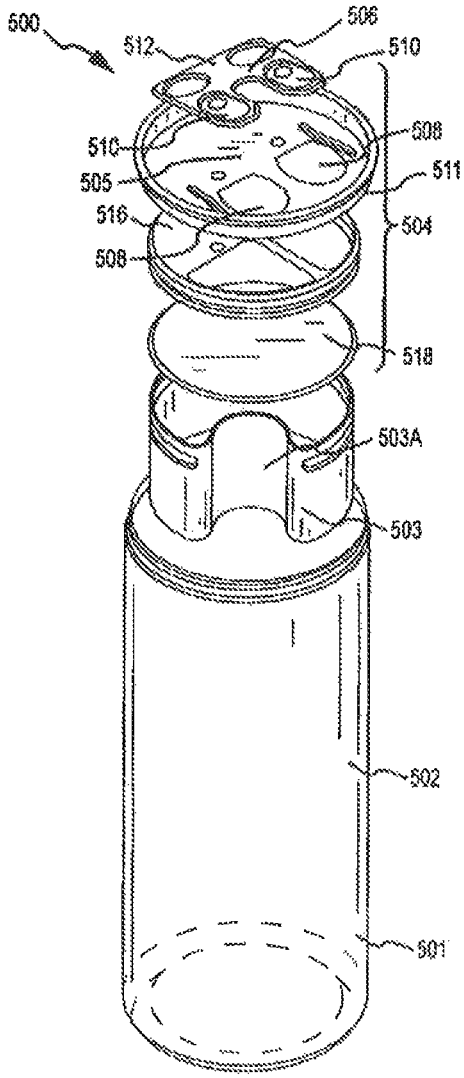
FIGS. 5A and 5B illustrate exploded views of an exemplary multiple-opening container in accordance with another exemplary embodiment of the present invention.

An exemplary multi-opening container can be configured in various manners for providing compartments, engagement devices/lids, and or sealing the container. In accordance with an exemplary embodiment, with reference to FIGS. 5A and 513, an exemplary container 500 comprises a container portion 502 having a first compartment 501 and a second compartment 503, and an engagement device 504. In accordance with this exemplary embodiment, rather than second compartment comprising a tube-like structure 202 illustrated in FIG. 2, second compartment 503 can comprise a substantially more narrow and wider configuration that is configured to be coupled to engagement device 504, and suitably positioned within an upper portion of first compartment 501. Second compartment 503 can comprise various shapes, sizes and arrangement for containing a material, beverage and the like, e.g., a single-shot of alcohol.

Figure 6A:
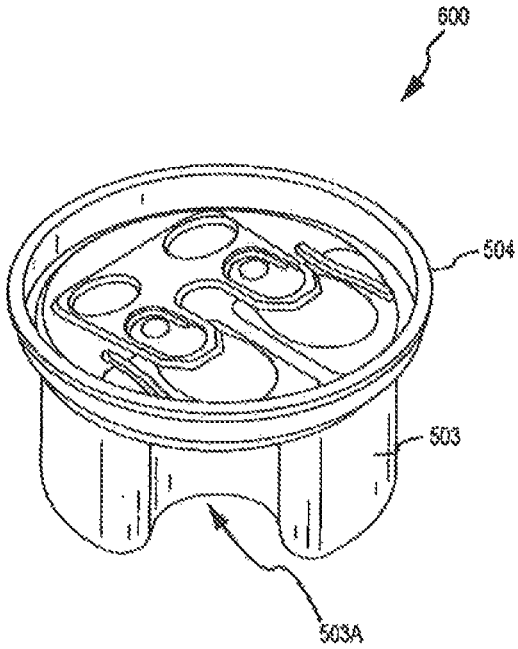
FIGS. 6A and 6B illustrate perspective and cross-sectional views, respectively, of an exemplary multiple-opening container in accordance with an exemplary embodiment of the present invention.
Figure 6B:
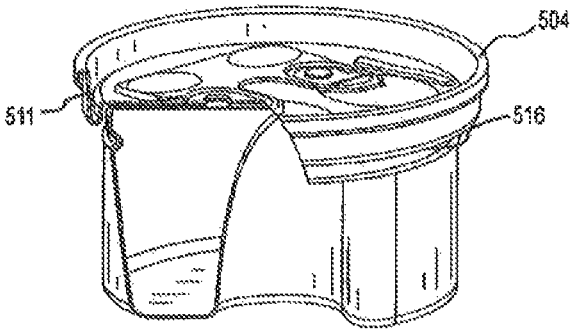

In accordance with an exemplary embodiment, engagement device 504 suitably comprises, in addition to a multi-opening tab 506, cap members 508, and contact portions 510, a ring portion 511 and a snap clip 516. With additional reference to an exemplary container coupling arrangement 600 illustrated in FIG. 6, ring portion 511 and snap clip 516 are suitably configured to provide a locking or sealing engagement with second compartment 503 to beverage can 502. Snap clip 516 suitably comprises a pair of openings to facilitate filling or pouring of beverages and materials from first compartment 501 and second compartment 502, with such openings being configured in any shape and/or dimension to enable such materials or beverages to flow through. Snap clip 516 is further configured to join or otherwise couple ring portion 511 to second compartment 503. As a result of ring portion 511 and clip 516, second compartment 503 can be suitably filled with a beverage or other material and sealed, with engagement device 504 then being suitably configured for insertion of second compartment 503 into and coupling or locking to container portion 502.

Figure 8:
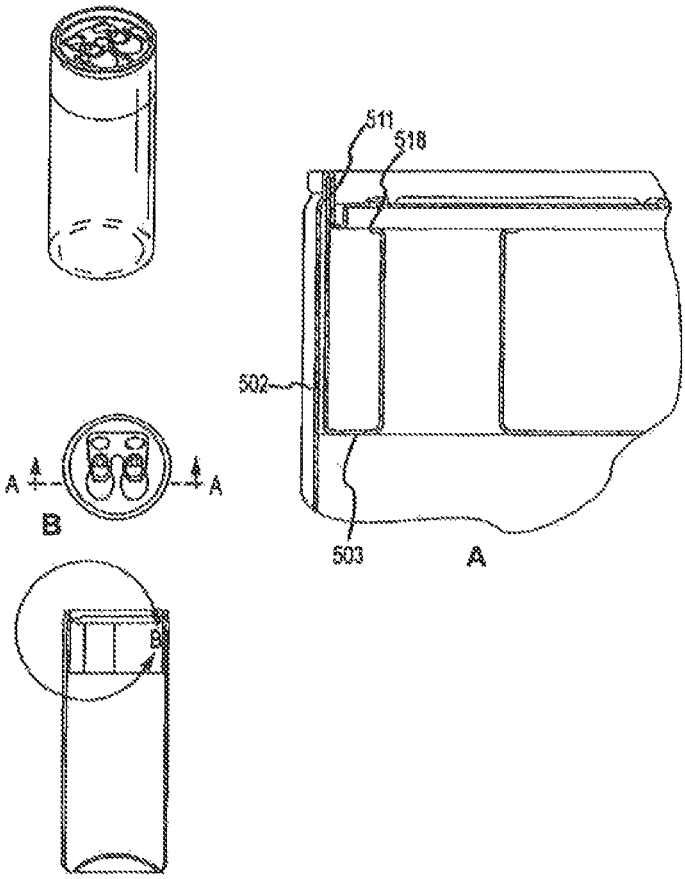
FIGS. 8A-8C illustrate cross-sectional and top views of an exemplary multiple-opening container in accordance with an exemplary embodiment of the present invention.

For example, with additional reference to FIG. 8A, second compartment 503 and engagement device 504 (comprising ring portion 511 and snap clip 516) can be suitably positioned within container portion 502, with ring portion 511 being crimped or otherwise coupled to container portion 502 to provide a sealed connection. Snap clip 516 and ring portion 511 can comprise various configurations for facilitating attachment by engagement device 504 to second compartment 503 and/or to container portion 502.

Although an exemplary embodiment comprises ring portion 511 and snap clip 516 as two separate components thereafter attached, ring portion 511 and snap clip 516 can also be configured or integrated as a single component comprising both structures and/or functions, i.e., to enable second compartment to be filled and/or sealed within container portion 502. In addition, engagement device 504 can be configured without snap clip 516 (either apart from or integrated within ring portion 511), wherein ring portion 511 is configured to join, couple or otherwise attach second compartment 503 within container portion 502. For example, with reference again to FIG. 8A, second compartment 503 and engagement device 504 (comprising only ring portion 511 without snap clip 516) can be suitably positioned within container portion 502, with ring portion 511 being crimped or otherwise coupled to directly clamp second compartment 503 and container portion 502 to provide a sealed connection between.

Figure 9:
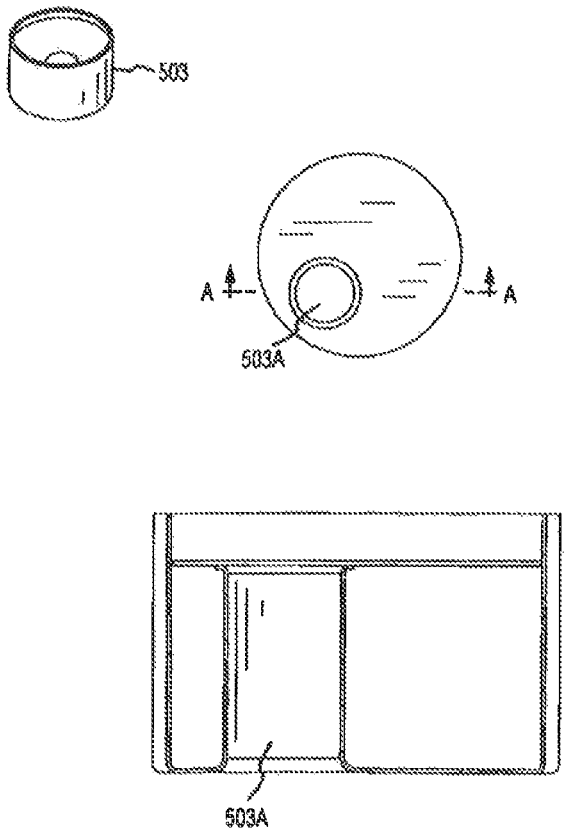
FIG. 9 illustrates a cross-sectional view of an exemplary compartment of a multiple-opening container in accordance with an exemplary embodiment of the present invention.
Figure 10:
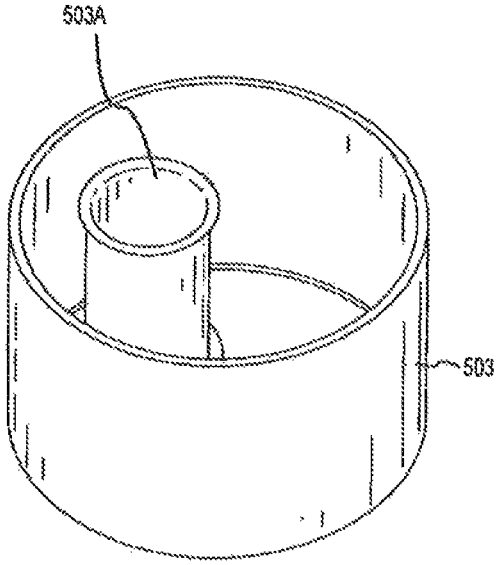
FIG. 10 illustrates a perspective view of an exemplary compartment of a multiple-opening container in accordance with an exemplary embodiment of the present invention.

To facilitate the filling of first compartment 501, second compartment 503 can be suitably configured with a pass through arrangement. For example, in accordance with an exemplary embodiment, with reference to FIG. 5A or 6A, a pass through 503A can be configured along an edge of second compartment 503. In accordance with another exemplary embodiment, pass through 503A can also be configured within an interior of second compartment 503, such as the embodiments illustrated in FIGS. 9 and 10. Pass through 503A can comprise various width, shapes and sizes for allowing a beverage or material to be poured through after sealing or enclosure of second compartment 503 and engagement device 504 with container portion 502.

Figure 5B:
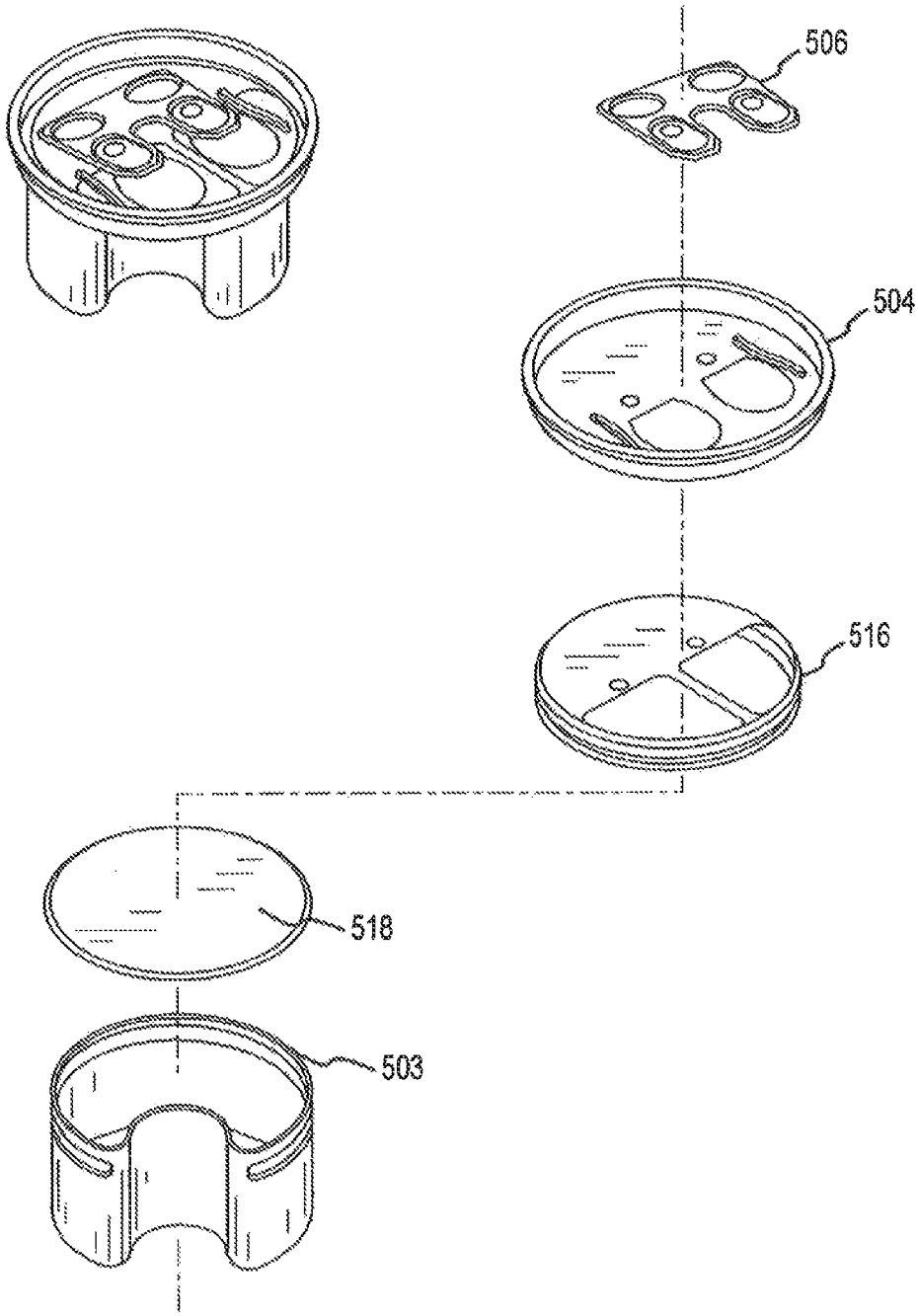
Figure 7:
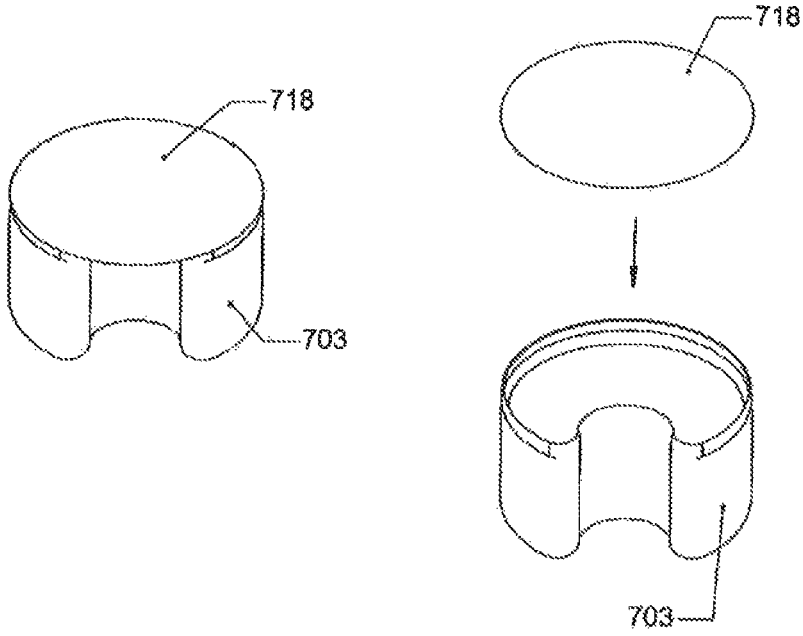
FIG. 7 illustrates a perspective view of an exemplary compartment of a multiple-opening container in accordance with an exemplary embodiment of the present invention.

In accordance with another exemplary embodiment, with reference again to FIGS. 5A and 5B, second compartment 503 can also be configured with a seal 518 to allow for beverages or materials to be filled within second compartment 503 prior to engagement with engagement device 504. For example, with momentary reference to FIG. 7, a seal 718 can be configured to cover the opening of a second compartment 703 after filling of beverage or materials within second compartment 703. For example, second compartment can be filled with material or beverages, and then placed within container portion 502 and then crimped or locked, with first compartment 501 being filled prior to sealing with seal 518. In addition, although seal 518 is configured to cover pass through 503A that leads to first compartment 501, seal 518 can also be suitably configured to have an opening corresponding to pass through 503A such that only second compartment is sealed. For example, second compartment can be filled with material or beverages and sealed with seal 518, and then placed within container portion 502 and then crimped or locked, with first compartment 501 being filled thereafter.

Seal 518 can be suitably coupled, fastened, glued or otherwise sealed in any conventional manner for coupling to containers. Seal 518 can comprise foil, plastics, paperboard, or any other like material that suitably provides a seal to prevent the spillage or other loss of beverage or materials from second compartment 503 when completely sealed, and yet allow for the puncture or other opening of seal 518 when it is desirable to access the beverages within, such as, for example, by puncture initiated when cap members 508 are pushed downward upon pulling upwards of tab 512. However, any other mechanism for puncturing or opening of seal 518 to allow beverages or other materials to be poured through and out of first compartment 501 and second compartment 502 are contemplated herein.

The present invention sets forth a multiple-opening container that can facilitate simultaneous pouring and mixing of multiple materials in a desired proportion after opening. It will be understood that the foregoing description is of exemplary embodiments of the invention, and that the invention is not limited to the specific forms shown. Various modifications may be made in the design and arrangement of the elements set forth herein without departing from the scope of the invention. For example, the materials for the exemplary container, tab and cap members, and other components can comprise any metals, plastics, glass, wood or any other like materials or any combinations thereof. Moreover, an exemplary container is not limited to beverages, but can also contain one or more fluids, powders, gels or other substances, and/or combinations thereof, used for mixing. Still further, the shapes and sizes of the various components, such as the container portion, engagement device, tab members, contact portions and cap members can be configured in any manner to perform the intended functions. These and other changes or modifications are intended to be included within the scope of the present invention, as set forth in the following claims.

The invention claimed is:

1. A multiple-opening container configured for containing at least two materials, said multiple-opening container comprising:

a container portion comprising a first compartment and a second compartment;

an engagement device configured for simultaneous piercing of both a first cap and a second cap, wherein piercing said first cap pierces a sealed access to a pass-through portion of said second compartment to facilitate simultaneous pouring and mixing of said at least two materials after simultaneous opening, wherein said sealed access and said first cap are two distinct elements;

a coupling arrangement, and a multi-opening tab member, wherein said multi-opening tab member comprises a first contact portion and a second contact portion, wherein said first contact portion is configured to contact said first cap and wherein said second contact portion is configured to contact said second cap.

2. The multiple-opening container according to claim 1, wherein said second compartment comprises a smaller volume container than said first compartment, and is configured to he filled with material prior to coupling with said engagement device to be sealed to said container portion.

3. The multiple-opening container according to claim 1, wherein said multi-opening tab member comprises a singular member configured for simultaneous engagement by said first and second contact portions of said first cap and said second cap to facilitate simultaneous opening via piercing said top cover of said second compartment of said multiple-opening container.

4. The multiple-opening container according to claim 3, wherein said first and second cap members are configured proximately together.

5. The multiple-opening container according to claim 1, wherein said second compartment comprises a pass-through portion to allow for beverage or other material to be poured from said first compartment after simultaneous opening both said second cap and said sealed access to said pass-through portion of said second compartment.

6. A method for facilitating simultaneous pouring of at least two materials from a single container, said method comprising:

filling a first compartment within said single container with a first material;

filling a second compartment with a second material;

placing said second compartment within said single container and interlocking, via a first crimped engagement, said second compartment with said single container;

operating an engagement device to simultaneously engage a first contact portion and a second contact portion with a first cap member and a second cap member to simultaneously pierce a first cap and a second cap, wherein piercing said first cap pierces a sealed access to a pass-through portion of said second compartment; and simultaneously pouring said at least two materials from said first and second material compartments of said container.

7. The method according to claim 6, wherein said method further comprise sealing said second material within said second compartment with a cover via a second crimped engagement prior to coupling said second compartment to said first compartment via said first crimped engagement.

8. The method according to claim 6, wherein said at least one material is poured through a pass-through portion configured within said second compartment.

9. The method according to claim 8, wherein said pass-through portion is configured within an outer perimeter of said second compartment.

10. A multiple-opening container configured for containing a first fluid and a second fluid, said multiple-opening container comprising:

a housing comprising a first compartment, wherein said housing is configured to receive a second compartment via a first crimped engagement, wherein said second compartment comprises a pass-through portion to allow for said second fluid to be poured from said first compartment after simultaneous opening of said first compartment and said second compartment; and a fluid engagement device configured for simultaneous piercing of a first covering of said second compartment at a first location and a second covering of said first compartment for opening of said first compartment and said second compartment to facilitate simultaneous pouring of said first fluid and said second fluid after simultaneous opening, wherein said fluid engagement device is configured for piercing said first covering of said second compartment at a second location to pierce said second covering of said second compartment.

11. The multiple-opening container according to claim 10, wherein said fluid engagement device further comprises:

a first contact portion and a second contact portion;

a first cap member and a second cap member operatively coupled to a first and a second contact portions of a multi-opening tab; and a ring portion configured for coupling to said second compartment, said multi-opening tab and said first and second cap members configured within said ring portion.

12. The multiple-opening container according to claim 11, wherein said first and second cap members are configured proximately together to facilitate simultaneous opening and pouring of said first fluid and said second fluid.

13. The multiple-opening container according to claim 10, wherein said second compartment comprises a smaller volume container than said first compartment.

14. The multiple-opening container according to claim 10, wherein said second compartment is substantially positioned between said seal and said first compartment.

15. The multiple-opening container according to claim 1, wherein said first compartment is coupled to said second compartment through a first crimped engagement and a cover of said second compartment is coupled to said second compartment through a second crimped engagement.

16. The multiple-opening container according to claim 15, wherein said second compartment comprises a cover of said first compartment.

17. The multiple-opening container according to claim 1, wherein said sealed access covers at least one of:

a) said pass-through portion of said second compartment and said second compartment, and b) said pass-through portion of said second compartment said not said second compartment.

18. The method according to claim 6, wherein said second compartment comprises a cover of said first compartment.

19. The method according to claim 6, wherein said sealed access covers at least one of:

a) said pass-through portion of said second compartment and said second compartment, and b) said pass-through portion of said second compartment and not said second compartment.

20. The multiple-opening container according to claim 10, wherein said first covering of said second compartment is coupled to said second compartment through a second crimped engagement.

* * * * *